United States Patent [19]

Sakabe et al.

[11] Patent Number: 4,635,402

[45] Date of Patent: Jan. 13, 1987

[54] KNIFE ABRASIVE APPARATUS FOR ROTARY DRUM SHAPED CUTTER

[75] Inventors: Busaburo Sakabe, Yokohama; Kounosuke Hyuga, Oisomachi; Kazuhito Araki, Hiratsuka, all of Japan

[73] Assignee: Japan Tobacco, Inc., Tokyo, Japan

[21] Appl. No.: 705,309

[22] Filed: Feb. 25, 1985

[30] Foreign Application Priority Data

Mar. 15, 1984 [JP] Japan ..... 59-48217

[51] Int. Cl.[4] ..... B24B 9/04; B24B 9/00

[52] U.S. Cl. ..... 51/74 BS; 51/249; 51/74 R; 51/72 R; 51/34 C

[58] Field of Search ..... 51/249, 222, 225, 74 R, 51/34 C, 74 BS, 72 R, 34 BR, 34 R

[56] References Cited

U.S. PATENT DOCUMENTS

| | | | |
|---|---|---|---|
| 1,654,236 | 6/1927 | Binns | 51/74 R |
| 3,374,699 | 7/1965 | Schmermund | 51/249 |
| 3,726,047 | 4/1973 | Long | 51/249 |

*Primary Examiner*—Frederick R. Schmidt
*Assistant Examiner*—Bradley I. Vaught
*Attorney, Agent, or Firm*—Murray and Whisenhunt

[57] ABSTRACT

A knife abrasive apparatus for a rotary drum shaped cutter can grind the knife edge without causing it to be serrated. It has a rotary drum shaped cutter including a rotary drum and knives spacedly disposed on the outer periphery of the drum at a predetermined helical angle to a virtual surface which blade edges of the knives will draw. It also has an abrasive wheel to be used for grinding the edges. The wheel is declined at the rotary center axis with respect to a vertical plane to the rotary center axis of the cutter so that a composite vector composed of a peripheral velocity vector of the cutter and that of the wheel will become parallel to each of the edges in the longitudinal direction of each of the knives. The velocity of rotation of the cutter and the wheel is controlled to maintain the ratio of the peripheral velocity of the former and the latter constant. The abrasive wheel is supported by a movable supporting member.

6 Claims, 17 Drawing Figures

KNIFE ABRASIVE APPARATUS FOR ROTARY DRUM SHAPED CUTTER

BACKGROUND OF THE INVENTION

The present invention relates to a knife abrasive apparatus for a rotary drum shaped cutter which will be employed in, for example, a shredding machine.

Generally, in order to shred leaf tobacco into cut tobacco for cigarettes, a tobacco shredding machine is used wherein laminated leaf tobacco is transferred to a shredding port formed at an exit of two converging press conveyors while compressing it by said conveyors, and after passing therethrough, the laminated leaf tobacco is shredded by a rotary drum shaped cutter having a knife edge which moves on a virtual cylindrical outer surface (hereinafter referred to as "blade edge cylinder") proximate to the shredding port.

In the above tobacco shredding machine, an abrasive apparatus is provided separately from the rotary drum shaped cutter in order to grind the knife blade edge during operation, so that the edge will be fit for high speed processing for a long time. Also, in order to maintain a gap between the blade edge cylinder and the shredding port constant, the knife is continuously or intermittently sent out by a very small amount at a time in synchronism with the rotation of the rotary drum shaped cutter in order to compensate for the length ground, and thus the diameter of the blade edge cylinder is always maintained constant.

In general, there are two abrasive systems; one is a wet type abrasive system in which an abrasive oil is supplied to the surface of the abrasive wheel for the purposes of prevention of heating, and discharge of abrasive grains worn out as well as chips ground by the abrasive grains, and the other is a dry type abrasive system in which the grinding is done by supplying no oil. In the tobacco shredding machine described, the dry type abrasive system is usually employed in order to prevent a decrease in the quality (aroma or taste, or physical property of a final product) of shredded tobacco due to possible attachment of the abrasive oil to leaf tobacco and shredded tobacco.

In the dry abrasive system, the grain size of the abrasive grain is made coarse in order to prevent the heating of the grindstone surface or to discharge the abrasive grain worn out and chips. Because of the foregoing, in an abrasive apparatus employing said dry type abrasive system, the blade edge of a knife ground is often caused to be serrated to such a degree as to be visually observable with the naked eye.

For the purposes of reducing the losses of raw material at a time when it is shredded as much as possible, the applicant of the present patent application suggested in Japanese Patent Application Post-Examination Publication No. 56(1981)-17910 a tobacco shredding machine equipped with a rotary drum shaped cutter wherein the knife is formed in a shape of a cylinder partly diagonally cut, and the knife blade edge is disposed at a predetermined helical angle with respect to the outer peripheral surface of the drum. However, when the above-mentioned abrasive apparatus is applied to this, the serrated blade edge of the knife causes the raw material to be sewn into too tiny grains as to make meaningless the predetermined helical angles (for slicing the raw material in order to minimize the losses thereof) at which the knife blade edge is disposed to the outer peripheral surface of the drum.

The present invention was accomplished in view of the above.

SUMMARY OF THE INVENTION

It is therefore a general object of the invention to provide a knife abrasive apparatus for a rotary drum shaped cutter which can effect the grinding operation without causing the blade edge of the knife of the rotary drum shaped cutter disposed at a predetermined helical angle with respect to be outer peripheral surface of the drum to become serrated.

Another object of the invention is to provide a knife abrasive apparatus for a rotary drum shaped cutter which can improve the grinding efficiency.

A further object of the invention is to provide a knife abrasive apparatus for a rotary drum shaped cutter which is simple in its constitution and easy in its maintenance without using any special mechanisms.

In order to achieve the above object, there is essentially provided an abrasive apparatus for a rotary drum shaped cutter comprising: a rotary drum shaped cutter including a rotary drum and a plurality of knives spacedly disposed on the outer peripheral surface of said rotary drum at a predetermined helical angle with respect to a virtual cylindrical outer surface which the blade edges of said knives will define; an abrasive wheel adapted to grind said knife blade edges, said abrasive wheel being declined at the rotary center axis thereof with respect to a vertical plane to the rotary center axis of said rotary drum shaped cutter so that a composite vector composed of a peripheral velocity vector of said rotary drum shaped cutter and a peripheral velocity vector of said abrasive wheel will become parallel relative to each of said knife blade edges in the longitudinal direction of each of the knives; means for controlling the velocity of rotation of said rotary drum shaped cutter and said abrasive wheel so that the ratio of the peripheral velocity of the former and the latter will be maintained constant; and a movable supporting member adapted to support said abrasive wheel and reciprocally movable in the axial direction of said rotary drum shaped cutter.

BRIEF DESCRIPTION OF THE DRAWINGS

The figures illustrate embodiments of the present invention wherein:

FIG. 5 through FIG. 14 illustrate the first embodiment in more detail wherein:

FIG. 5 is a plan view, partly cut away;

FIG. 6 is a front view;

FIG. 7 is a perspective view, partly omitted;

FIG. 8 is a side sectional view of a grinding stone supporting mechanism;

FIG. 9 is likewise a front view, partly cut away;

FIG. 10 is a side view of a grinding stone indexing mechanism;

FIG. 11 is a cross sectional view;

FIG. 12 is a vertical sectional view;

FIG. 13 is a front view of a dressing apparatus, partly cut away;

FIG. 14 is likewise a sectional view;

FIG. 15 through FIG. 17 illustrate a second embodiment in more detail wherein:

FIG. 15 is a front view;

FIG. 16 is a partly sectional side view; and

FIG. 17 is a side view.

DETAILED DESCRIPTION OF THE EMBODIMENTS

Preferred embodiments of the present invention will be described with reference to the accompanying drawings.

Figure 1:
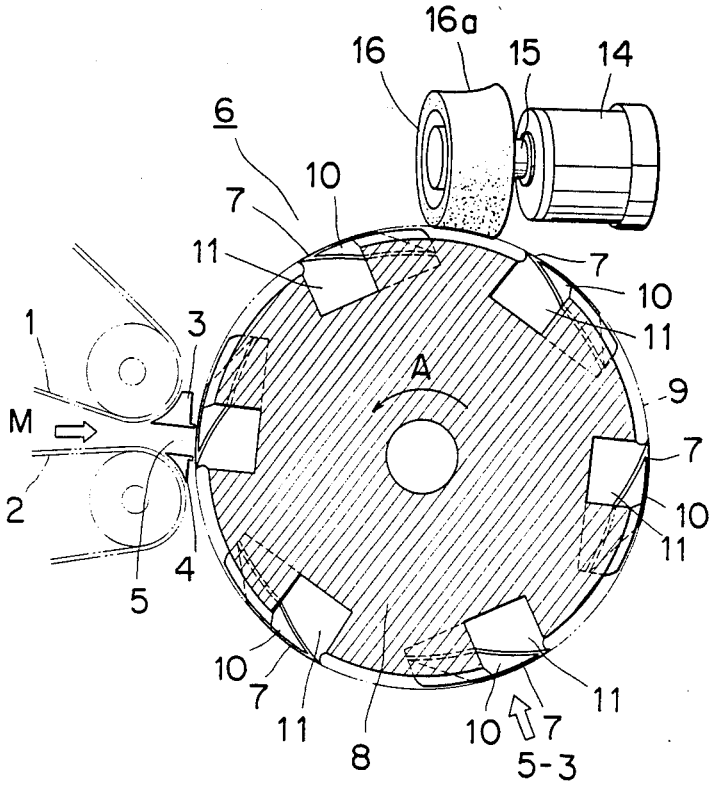
FIG. 1 is a schematic side view of a first embodiment of the present invention.
Figure 2:
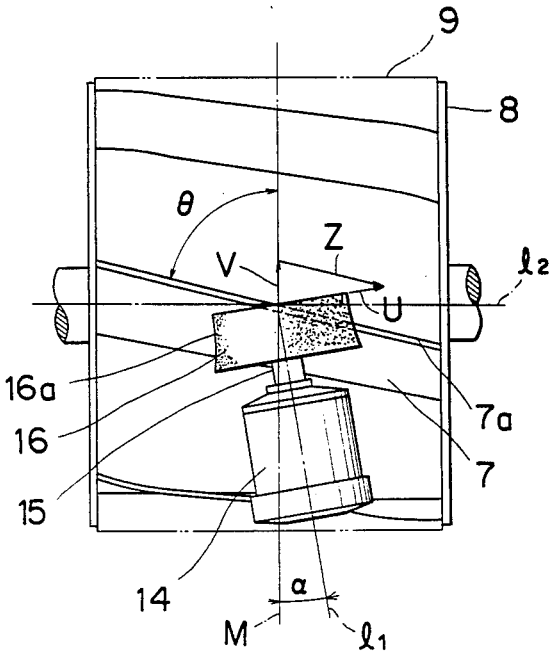
FIG. 2 is a schematic plan view of the above.

FIG. 1 and FIG. 2 are schematic views of one embodiment of the present invention. Converging upper and lower press conveyors 1 and 2 are provided near head pulleys thereof with a shredding port 5 defined by a compression plate 3, a blade receiving plate 4 and a pair of right and left guides (not shown). A rotary drum shaped cutter 6 is disposed in the proximity of said shredding port 5 for rotation in the direction of an arrow A.

This rotary drum shaped cutter 6 shreds the mass of flattened raw material M fed from the shredding port 5 into a predetermined width. The cutter 6 comprises a plurality of knives 7 each in a shape of a cylinder partly diagonally cut, said knife 7 being spacedly disposed on the outer peripheral surface of the rotary drum 8 at a predetermined angle $\theta$ with respect to a blade edge cylinder 9 to be drawn by a blade edge *7a* of the knife 7.

Each of the knives 7 is feedably clamped on a respective one of tables 11 provided on the outer peripheral surface of the rotary drum 8 by a respective one of clamp plates 10 having an identical configuration as that of the knife 7 and is indexed for a predetermined pitch at a time by an indexing mechanism 60, 61, 62, 63, 64 and 65 (see FIG. 7) provided within the rotary drum 8.

With the above constitution, the rotary drum shaped cutter 6 is provided with a movable supporting member 13 thereon (see FIG. 5 through FIG. 7) for reciprocal movement in the axial direction. Said movable supporting member 13 is provided with a drive motor 14 and an abrasive wheel 16 mounted on the output shaft 15 thereof.

The abrasive wheel 16 is disposed on the movable supporting member 13 in such a manner as that the rotary center axis $l_1$ of the wheel 16 is inclined at an angle of $\alpha$ to an vertical plane M with respect to a rotary center axis $l_2$ of the rotary drum shaped cutter 6. This angle $\alpha$ is set as such that the moving velocity vector Z of the abrasive wheel 16 in the grinding direction will be generally in agreement with the helical direction which is to be drawn by the knife blade edge *7a* on the blade edge cylinder 9, said moving velocity vector Z being a composite of the peripheral velocity vector V of the blade edge cylinder 9 and the peripheral velocity vector U of the abrasive wheel 16. Also, the respective rotary velocity of the rotary drum shaped cutter 6 and of the abrasive wheel 16 is controlled in such a manner as to maintain the ratio of the peripheral velocity of the former and that of the latter constant.

The peripheral surface of the abrasive wheel 16 is depressed in an arcuate shape generally in agreement with the blade edge cylinder 9 to form an abrasive plane *16a*. A whole or a part of the abrasive plane *16a* contacts the blade edge cylinder 9 in the axial direction.

According to the above embodiment, by rotating the rotary drum shaped cutter 6 in the direction of an arrow A, the knife blade edge *7a* bites, little by little, into the tobacco row material M fed from the shredding port 5 without incurring an abrupt shock thereto for slicing.

According to the rotation of the rotary drum shaped cutter 6, the indexing mechanism 60, 61, 62, 63, 64 and 65 is actuated to index the knife blade edge *7a* by a predetermined pitch at a time. Simultaneously, the movable supporting member 13 is reciprocated in the axial direction of the rotary drum shaped cutter 6 to have the abrasive wheel 16 grind the knife blade edge *7a*. At this moment, since the rotary center axis $l_1$ of the abrasive wheel 16 is inclined at an angle $\alpha$, and the ratio between the peripheral velocity of the rotary drum shaped cutter 6 and that of the abrasive wheel 16 is maintained constant, the abrasive wheel 16 is moved in such a manner as to be generally in agreement with the helical direction which the knife blade edge *7a* will draw on the blade edge cylinder 9. As a result, the abrasive grain direction of the knife blade edge *7a* is brought to be generally in agreement with the longitudinal direction of the knife blade edge *7a*. As a consequence, the knife blade edge *7a* can be ground without causing the sharp edge portion thereof to become serrated.

Also, the contact length in the longitudinal direction of the knife blade edge *7a* of the abrasive plane *16a* is longer by an angle $\alpha$ compared with the case where the rotary center axis $l_1$ of the abrasive wheel 16 is made in agreement with the vertical surface M. Because of the foregoing, the velocity of the reciprocal motion of the movable supporting member 13 can be made faster.

In the case the contact length is short, unless the reciprocal velocity of the movable supporting member 13 is made slow, the edge portion of the knife blade edge *7a* becomes coarse. Because of the foregoing, the abrasive efficiency of the abrasive wheel 16 with respect to the knife blade edge *7a* is lowered. However, in this embodiment, the abrasive efficiency can be improved corresponding to the angle.

Figure 3:
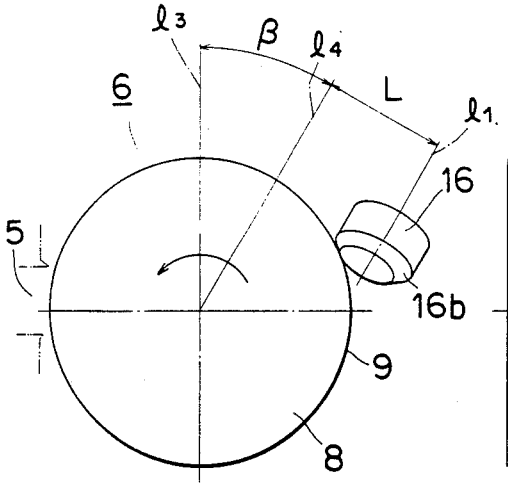
FIG. 3 is a schematic side view of a second embodiment of the present invention.
Figure 4:
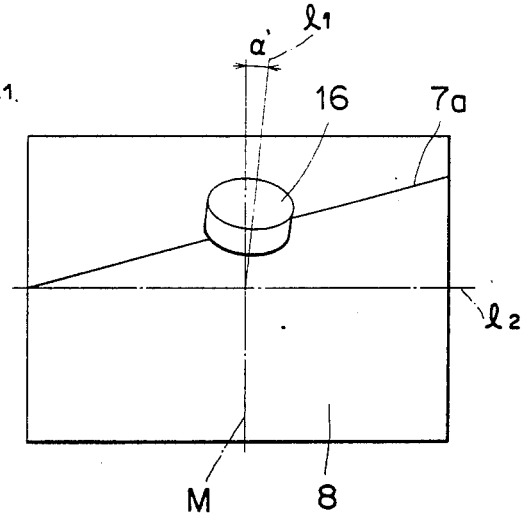
FIG. 4 is likewise a schematic plan view of the above.

FIG. 3 and FIG. 4 illustrate schematic views of a second embodiment of the present invention. In this second embodiment, one end portion in the direction of the abrasive wheel 16 is made as an abrasive plane *16b* so that the moving direction of the abrasive wheel 16 will be generally in agreement with the helical direction which the knife blade edge *7a* will draw on the blade edge cylinder 9.

That is, within a vertical plane M to the rotary center axis $l_2$ of the rotary drum shaped cutter 6, the rotary center axis $l_1$ of the abrasive wheel 16 is inclined by an angle $\beta$ to a vertical axis $l_3$ transversing the rotary center axis $l_2$ at right angles and also moved in parallel by a predetermined distance L from an inclined axis $l_4$ transversing the rotary center axis $l_2$ by inclining at an angle $\beta$ to said vertical axis $l_3$ and the rotary center axis $l_1$ is inclined by an angle $\alpha'$ to said vertical plane M.

The angle $\beta$ is set so that the abrasive plane *16b* contacts the blade edge cylinder 9, and said abrasive plane *16b* is depressed in a circular arc in order to be generally in agreement with the blade edge cylinder 9.

The angle $\alpha'$ is, as in the case with the angle $\alpha$ of the first embodiment, set so that the moving velocity vector Z of the abrasive wheel 16 is generally in agreement with the helical direction which the knife blade edge *7a* will draw on the blade edge cylinder 9.

In this second embodiment, since the abrasive grain direction of the knife blade edge *7a* is generally in agreement with the longitudinal direction of the knife blade edge *7a*, there is no risk that the sharp edge portion of the knife blade edge 7*a* is caused to be serrated. Also, since the contact length in the longitudinal direction of the knife blade edge 7*a* of the abrasive plane 16*b* is longer than that in the case without the angle $\alpha'$, the abrasive efficiency can be improved. In addition, since the one end portion in the axial direction of the abrasive wheel 16 is used as the abrasive plane 16*b*, there is no such worry as that the diameter of the abrasive wheel 16 will become smaller every time the grinding operation is performed thereby changing the peripheral velocity as in the case with the first embodiment. Because of the foregoing, if once set, the peripheral velocity of the abrasive wheel 16 with respect to the peripheral velocity of the rotary drum shaped cutter 6, no change is required any more. Only when the peripheral velocity of the rotary drum shaped cutter 6 is changed, the peripheral velocity of the abrasive wheel 16 may be changed accordingly. Further, since the rotary center axis $l_1$ is moved in parallel by a predetermined distance of L with respect to the inclined axis $l_4$, the abrasive plane 16*b* which now is not under grinding can be simultaneously subjected to the dressing treatment while the knife blade edge 7*a* is under grinding.

FIG. 5 through FIG. 12 illustrate the above mentioned first embodiment more in detail. First of all, the overall constitution will be described with reference to FIG. 5 through FIG. 7. Between side frame portions 17 and 18, guide shafts 19 and 20 are disposed in parallel with the rotary center axis $l_2$ of the rotary drum shaped cutter 6 within a same horizontal plane. Said guide shafts 19 and 20 are provided with a movable supporting member 13 for movement in the axial direction in a generally horizontal state.

Also, the side frame portions 17 and 18 are provided with sprocket assemblies 21 and 22, each assembly including a sprocket wheel mounted on a shaft, and, a timing belt 23 is disposed about the sprocket wheels of assemblies 21 and 22. Since the movable supporting member 13 is firmly secured to said timing belt 23, the driving of a drive motor (not shown) connected to either one of the sprocket wheels 21 and 22 causes the timing belt 23 to be actuated for the reciprocal movement of the movable supporting member 13.

On the upper surface of the movable supporting member 13, there is provided a grinding stone supporting mechanism 24 which supports the driving motor 14 and the abrasive wheel 16 for movement in the accessing direction to the rotary drum shaped cutter 6. This grinding stone supporting mechanism 24 comprises, as shown in detail in FIG. 8 and FIG. 9, a movable supporting member 13, a main body 25 provided on the upper surface of said member 13, a pair of supporting shafts 26 and 26 erected in parallel relative to each other on said main body 25 at a predetermined space, and a supporting block 27 mounted on said supporting shafts 26 and 26 for movement in the axial direction, said supporting block 27 supporting a drive motor 14 and an abrasive wheel 16 firmly secured thereto.

Figure 5:
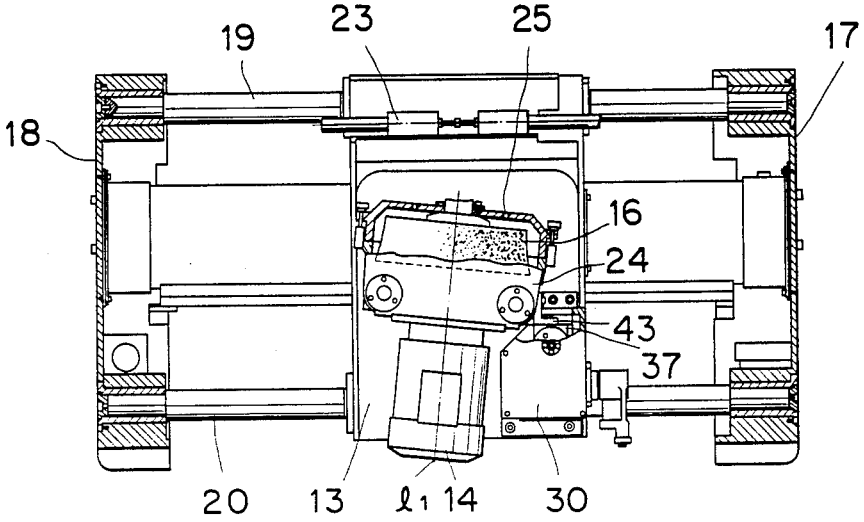
Figure 6:
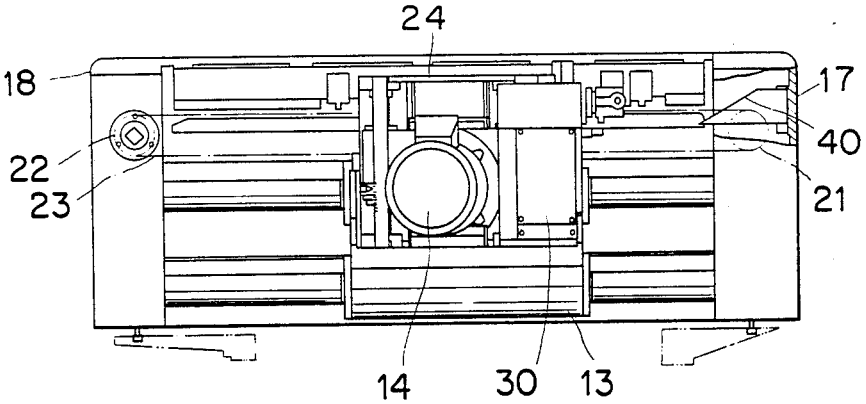

The main body 25 is, as shown in FIG. 5, mounted on the movable supporting member 13 in an inclined manner by an angle of $\alpha$ with respect to the rotary center axis. One of the supporting shafts 26 side is provided with a scale 28. In a predetermined position of the supporting block 27 in the vicinity of said scale 28, an instructing portion 29 is provided.

In this embodiment, since the peripheral surface of the abrasive wheel 16 is used as the abrasive plane 16*a*, every time the grinding is made, the abrasive grain is worn to diminish the diameter of the grinding stone. Therefore, on the upper surface of the movable supporting member 13, a grinding stone indexing mechanism 30 is provided adjacent to the grinding stone supporting mechanism 24 in order to index the drive motor 14 and the abrasive wheel 16 toward the rotary drum shaped cutter 6 side.

Figure 11:
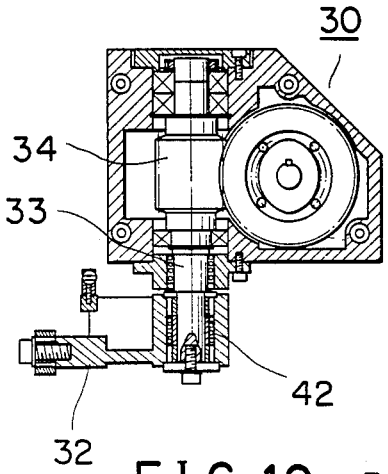
Figure 10:
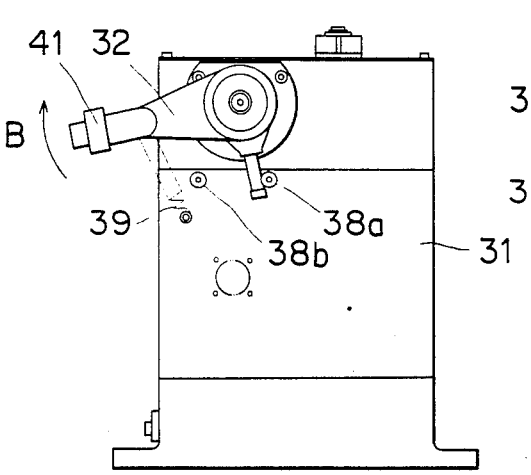
Figure 12:
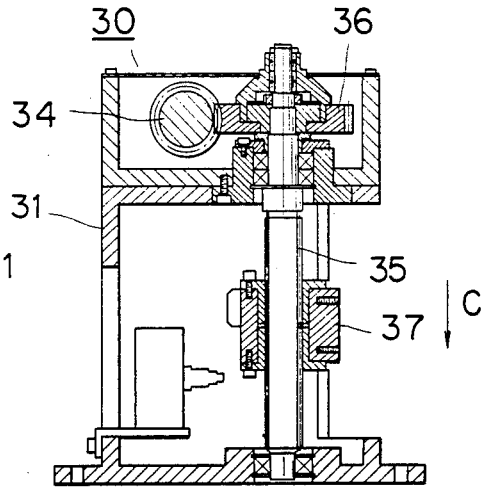

This grinding stone indexing mechanism 30 comprises, as shown in detail in FIG. 10 through FIG. 12, a box shaped main body 31, an oscillating arm 32 disposed at one side surface upper end position of said main body 31, a worm 34 provided on a portion of a shaft 33 positioned within the main body 31, a worm wheel 36 provided with said main body 31 at the upper end portion of a threaded shaft 35 erected upright for rotation and adapted to engage said worm 34, and a slide block 37 threadedly engaged with said threaded shaft 35 for movement in the axial direction thereof in accordance with the rotation of said threaded shaft 35.

The oscillating arm 32 is, as shown in FIG. 10, restricted to a range of oscillating movement by pins 38*a* and 38*b* provided on one side surface of said main body 31, and biased toward the pin 38*a* side by a spring 39 disposed between said oscillating arm 32 and the main body 31. Mounted on the free end of said oscillating arm 32 is a roller 41 adapted to roll on the inclined surface of a triangle shaped cam 40 (see FIG. 6) provided on one side frame portion 17.

Also, a one-way clutch 42 is disposed between said oscillating arm 32 and said shaft 33. The arrangement being such that only when the oscillating arm 32 is oscillated in the direction of arrow B, the torque is transmitted to the threaded shaft 35 through said one-way clutch 42.

Also, the slide block 37 is, as shown in FIG. 5, connected to said supporting block 27 through a generally L-shaped metal piece 43.

When the movable supporting member 13 is moved toward one side frame portion 17, the roller 41 rides over the inclined surface of the cam 40. As a result, the oscillating arm 32 is oscillated in the direction of arrow B as shown in FIG. 10 resisting the biasing force of said spring 39. This torque is transmitted to the worm wheel 36 and the threaded shaft 35 through the one-way clutch 42 and through the engagement between the worm 34 and the worm wheel 36. As a result, said threaded shaft 35 is turned in one direction to transfer the slide block 37 in the direction of arrow C as shown in FIG. 12. Because of the foregoing, the supporting block 27 is sent out toward the rotary drum shaped cutter 6 side by one pitch.

That is, at the time when the movable supporting member 13 effects a reciprocal movement, every time the movable supporting member 13 positions in the one side frame portion 17 side, said driving motor 14 and said abrasive wheel 16 are sent out in the accessing direction to the rotary drum shaped cutter 6 by one pitch at a time.

When the movable supporting member 13 is moved toward the other side frame 18 portion side, due to the biasing force of the spring 39, the oscillating arm 38 is oscillated in the opposite direction with respect to the direction of the arrow B as shown in FIG. 10. However, this torque is not transmitted to the threaded shaft 35 by the one-way clutch 42.

In case where said cam 40 is provided on the other side frame 18, every time said movable supporting member 13 is positioned in the other side frame portion 18 side, the drive motor 14 and the abrasive wheel 16 are sent out by one pitch at a time.

Figure 13:
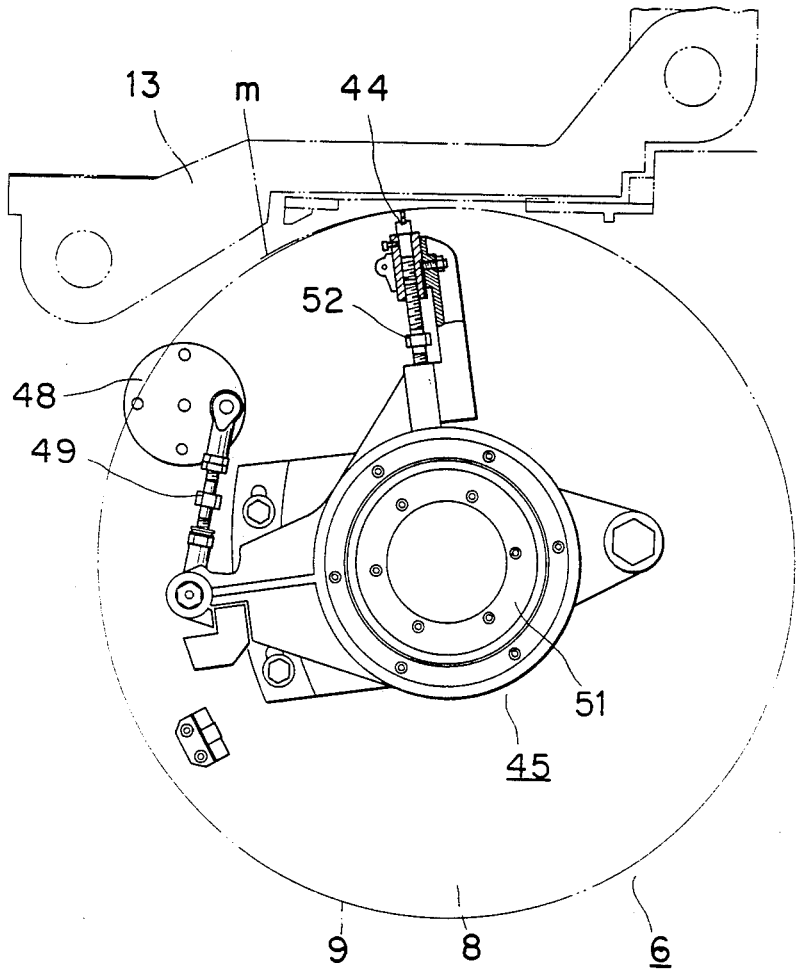
Figure 14:
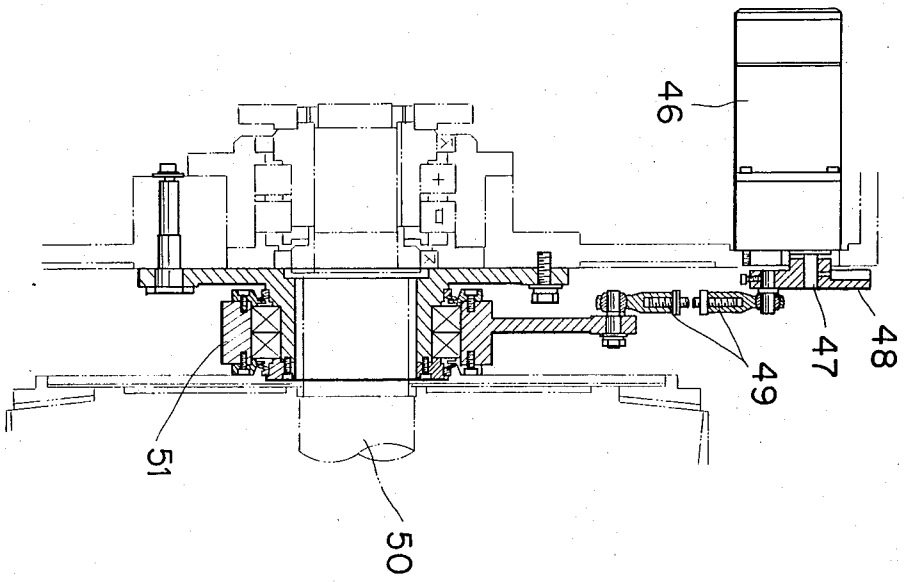

The side frame portion 18 is provided with a dressing apparatus 45 (see FIG. 13 and FIG. 14) including a diamond dresser 44 (see FIG. 13) which moves on a circular arc similar to the blade edge cylinder 9. This dressing apparatus comprises, as shown in FIG. 13 through FIG. 14, a drive motor 46 for the dresser, a link member 49 pivotally attached at one end thereof to the eccentric position of a disc board 48 firmly secured to an output shaft 47 of said drive motor 46 and which is adjustable its expansion and contraction and an oscillating arm 51 for the dresser mounted on the prime shaft 50 of the rotary drum 8 by slightly displacing thereto, the other end of said link member 49 being pivotally attached to said arm 51, said oscillating arm 51 supporting the diamond dresser 44.

The oscillating arm 51 is provided at the diamond dresser 44 supporting portion with a projection length adjusting mechanism 52 adapted to adjust the projection length of said diamond dresser 44.

When the drive motor 46 is actuated, its torque is converted to an oscillating motion by said disc board 48 and link member 49 and then transmitted to said oscillating arm 51. As a result, the diamond dresser 44 is moved along an arcuate orbit m which is similar to the blade edge cylinder 9 in order to effect dressing to the abrasive plane 16*a* of said abrasive wheel 16. As a result, the abrasive plane 16*a* which became coarse after grinding the knife blade edge 7*a*, is prepared to be in a shape which is generally in agreement with the blade edge cylinder 9.

The reason why the abrasive plane 16*a* is not prepared to be exactly same as the blade edge cylinder 9 is that by making an escape to the abrasive plane 16*a*, the abrasive plane 16*a* may be shifted over to the abrasive operation smoothly.

Since the abrasive wheel 9 is subjected to the dressing every time the grinding is made, the diameter of the grinding stone becomes diminished. However, since the velocity of the motor 14 is arranged to be increased as the diameter of the grinding stone becomes smaller by a control system (not shown) using a frequency inverter or the like which varies the power frequency or the like, the peripheral velocity of the abrasive wheel 16 can be maintained constant.

Also, in case where the rotational speed of the rotary drum shaped cutter 6 is varied, the ratio between the peripheral velocity of the blade edge cylinder 9 and that of the abrasive wheel 16 can be maintained constant.

Figure 7:
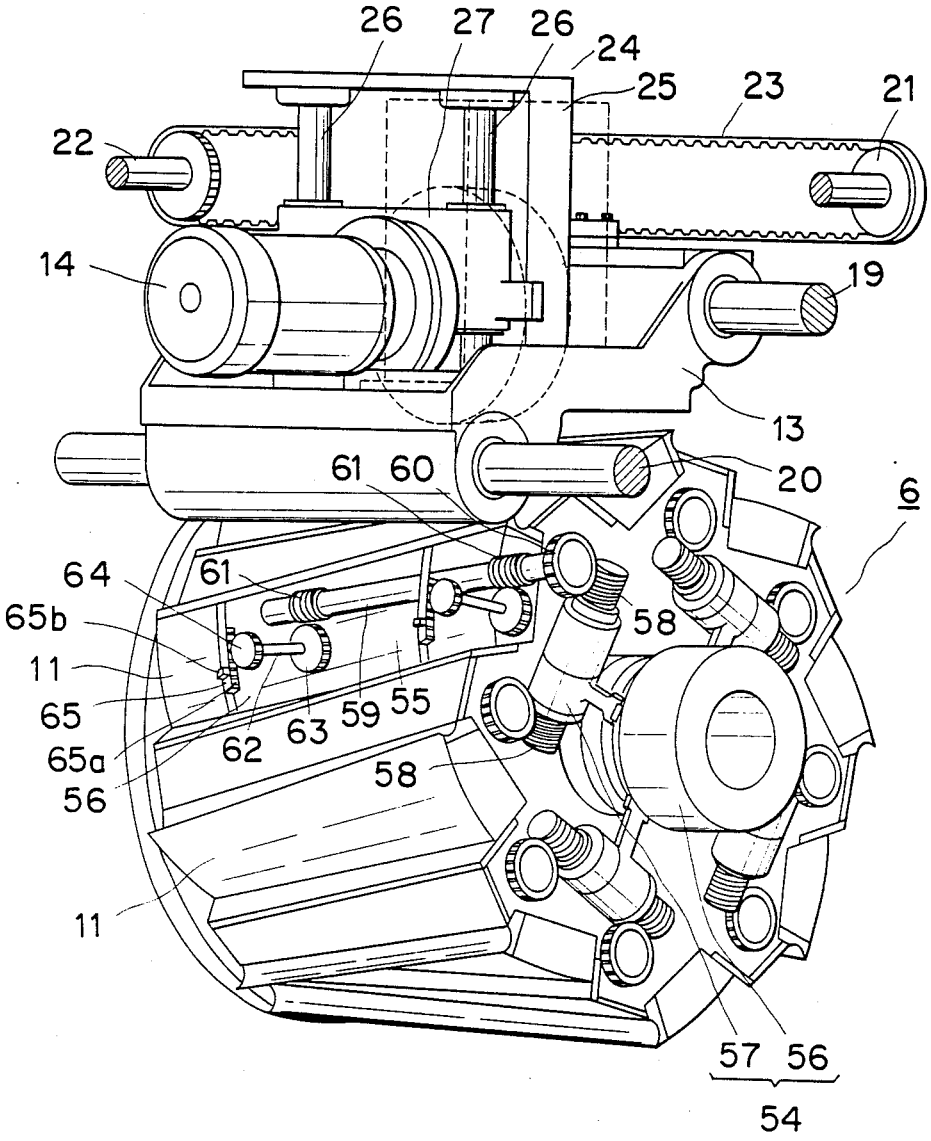
Figure 8:
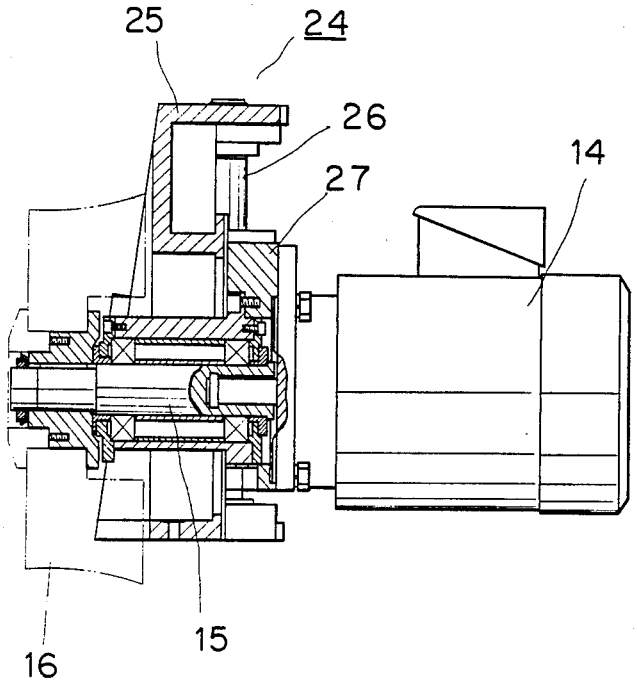
Figure 9:
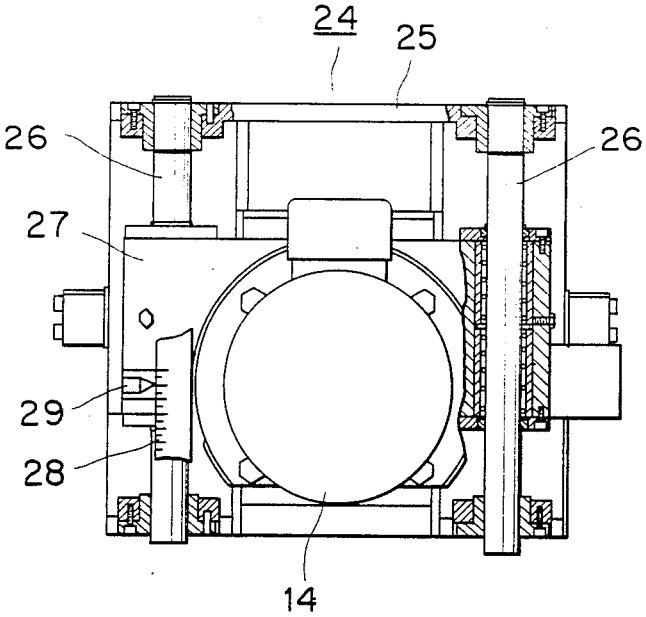

The afore-mentioned indexing mechanism 12 of the knife 7 comprises, as shown in FIG. 7, a transmitting portion 54 provided at the one end surface side of the rotary drum 8, an indexing portion 55 disposed within said table portion 11, a drive portion (not shown), and a control portion (not shown).

The transmitting portion 54 comprises a slide case unit 56 driven for reciprocation by a drive portion controlled by a control portion, and a clutch shaft 57 containing a one-way clutch to be rotated in one direction at a time when said slide case unit 56 is reciprocated. At the both ends of the clutch shaft 57, worm gears are provided.

The indexing portion 55 comprises a helical gear 60 meshed with a worm gear 58 provided at one end of a main shaft 59, worm gears 61 and 61 provided at one end portion side and the other end of said main shaft 59, helical gears 63 and 63 provided at one ends of knife field shafts 62 and 62 and adapted to mesh with said worm gears 61 and 61, bevel gears (pinions) 64 and 64 provided at the other end portions of said knife field shafts 62 and 62, and slide blocks 65 and 65 each including a detent 65*a* engaged with the knife 7 and a bevel gear (rack) 65*b* meshing with a respective one of the bevel gears 64 and 64.

When the drive apparatus is actuated by the control apparatus cooperatively associated with the rotation of the rotary drum shaped cutter 6, the torque is transmitted to the main shaft 59 through the slide case unit 56 and the clutch shaft 57. This torque is transmitted to the knife field shaft 62 through the meshing between the worm gear 61 and the helical gear 63, and is converted to a linear motion of the slide block 65 through the meshing between the bevel gears 64 and 65*b*. As a result, the knife 7 is sent out by one pitch by the detent 65*a*.

In the present embodiment, when the helical angle $\theta$ is 75° and the peripheral velocity of the blade edge cylinder 9 is 600 m/min, supposed the peripheral velocity of the abrasive wheel 16 is 1700 m/min, the angle $\alpha$ is preferably about 4.9°.

Figure 15:
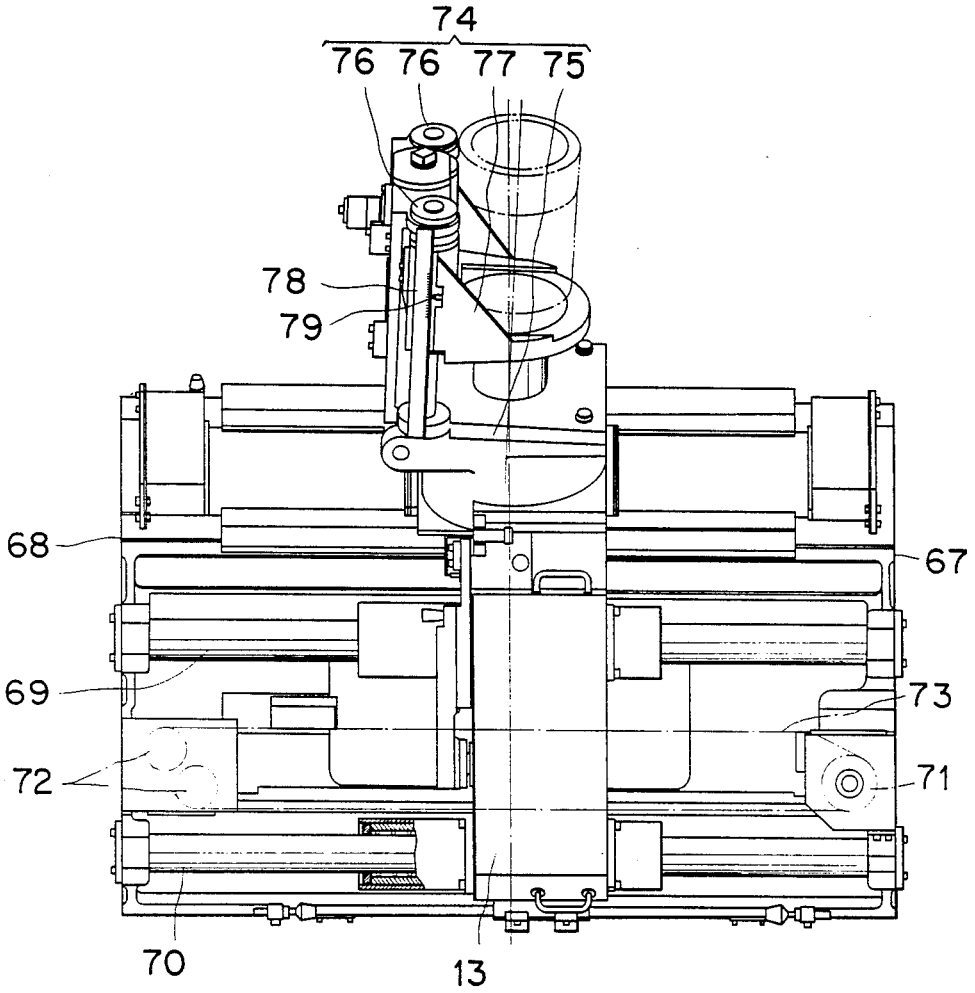
Figure 16:
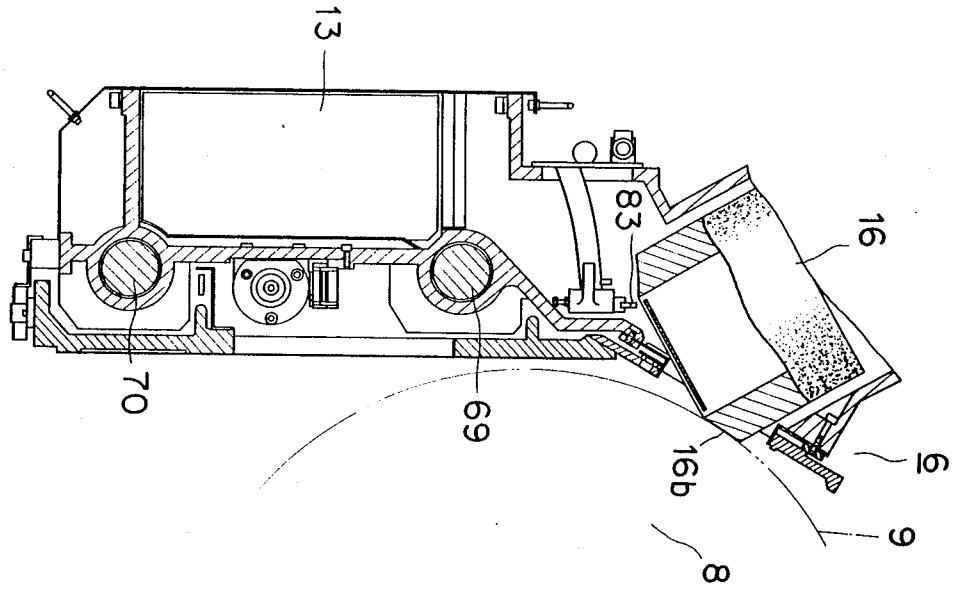
Figure 17:
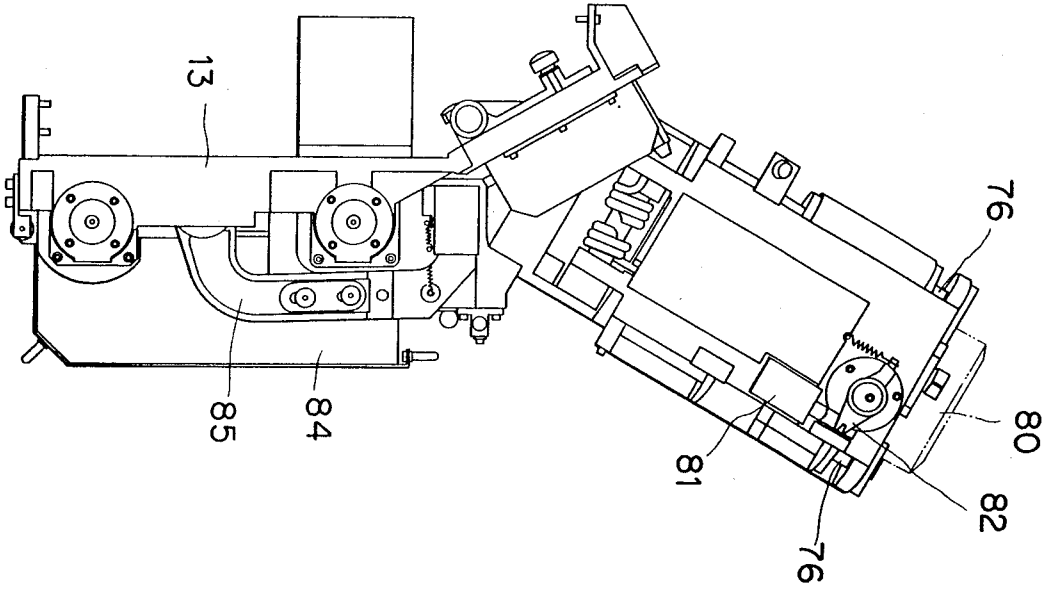

FIG. 15 through FIG. 17 illustrate the above second embodiment more in detail. In this second embodiment, guide shafts 69 and 70 are disposed between side frame portions 67 and 68 as such that the guide shafts 69 and 70 are parallel with the rotary center axis $l_2$ of the rotary drum shaped cutter 6 within a same vertical plane. These guide shafts 69 and 70 are provided with the movable supporting member 13 for movement in the axial direction in a generally vertical state.

Also, the side frame portions 67 and 68 are provided with sprocket wheels 71 and 72. Between these sprocket wheels 71 and 72, a timing belt 73 which is firmly secured to the movable supporting member 13 is disposed. Thus, by actuating the drive motor (not shown) connected to either one of the sprockets 71 and 72, the timing belt 73 is run so that the movable supporting member 13 will be reciprocated.

The upper end portion of the movable supporting member 13 is inclined toward the rotary drum shaped cutter 6 side. Although not shown in detail, a grinding stone supporting mechanism 74 is provided on said upper end portion. Said grinding stone supporting mechanism 74 is constituted as such that a pair of supporting shafts 76 and 76 are erected in parallel at a predetermined space on a main body 75 which is disposed in such a manner as to be inclined by angle $\beta$ to the vertical axis $l_3$ with respect to the upper end portion of the movable supporting member 13 and also inclined by angle $\alpha'$ to a transversing place perpendicular to the rotary center axis $l_2$, and said supporting shafts 76 and 76 are provided with a supporting table 77 for movement in the axial direction, said supporting table 77 being provided with the drive motor 14 and the abrasive wheel 16 firmly secured thereto. Provided on one of the supporting shafts 76 is a scale 78 and provided in a predetermined position of the supporting table 77 in the vicinity of said scale 78 is an instructing portion 79.

In this embodiment, since the one end portion in the axial direction of the abrasive wheel 16 is used as a grinding plane 16*b*, every time the grinding is effected, the abrasive grain is worn to diminish the dimension in the axial direction of the abrasive wheel 16. In view of the foregoing, the grinding stone supporting mechanism 74 is provided with a grinding stone mechanism 80.

Said grinding stone indexing mechanism 80 is constituted generally in the same manner as the afore-mentioned first embodiment. A different point is that an oscillating arm 82 is oscillated by using a solenoid 81, so that every time said solenoid 81 is actuated, said drive motor 14 and said abrasive wheel 16 are sent out by one pitch at a time toward the rotary drum shaped cutter 6 side.

Also, said movable supporting member 13 is provided with a dressing apparatus (see FIG. 16) including a diamond dresser 83 (see FIG. 16) which moves on an circular arc similar to the blade edge cylinder 9. This dressing apparatus 84 is constituted as such that the diamond dresser 83 is mounted on a free end of an oscillating arm 85 for the dresser pivotally attached at one end thereof to the movable supporting member 13. The oscillating motion of said oscillating arm 85 by a drive motor (not shown) causes the diamond dresser 83 to move along an arcuate orbit similar to the blade edge cylinder 9. As a result, the abrasive plane **16*b* of the abrasive wheel 16** is subjected to the dressing.

Different from the afore-mentioned first embodiment, in this embodiment, since the dressing apparatus 84 is disposed on the movable supporting member 13, the dressing can be effected at a time when the movable supporting member 13 effects a reciprocal movement, i.e., simultaneosuly with the grinding operation.

Also, although the dimension in the axial direction of the abrasive wheel 16 is diminished every time the grinding is effected, the diameter of the grinding stone is not changed. Therefore, no increase is required for the velocity of rotation of the drive motor 14 in order to maintain the peripheral velocity constant.

As described in the foregoing, according to the present invention, a knife abrasive apparatus for a rotary drum shaped cutter comprising a rotary drum shaped cutter including a rotary drum and a plurality of knives spacedly disposed on the outer peripheral surface of said rotary drum at a predetermined helical angle with respect to a virtual cylindrical outer surface which blade edges of said knives will draw; an abrasive wheel adapted to grind said knife blade edges, said abrasive wheel being declined at the rotary center axis thereof with respect to a vertical plane to the rotary center axis of said rotary drum shaped cutter so that a composite vector composed of a peripheral velocity vector of said rotary drum shaped cutter and a peripheral velocity vector of said abrasive wheel will become parallel relative to each of said knife blade edges in the longitudinal direction of each of the knives; means for controlling the velocity of rotation of said rotary drum shaped cutter and said abrasive wheel so that the ratio of the peripheral velocity of the former and the latter will be maintained constant; and a movable supporting member adapted to support said abrasive wheel and reciprocally movable in the axial direction of said rotary drum shaped cutter. The constitution being such that the grinding operation can be effected without causing the knife blade edge serrated. Thus, the effect from such an arrangement as that the knife blade edge is disposed at a predetermined helical angle to the outer peripheral surface of the drum can be obtained. In other words, such an effect as that the losses of raw material due to crushing are decreased by a slice cutting as much as possible is obtainable.

Furthermore, the abrasive efficiency can be improved. In addition, a simple constitution and an easy maintenance are obtainable without using any special mechanisms.

What is claimed is:

1. A knife abrasive apparatus for a rotary drum shaped cutter comprising:

a rotary drum and a plurality of knives, each of said knives having a blade edge, said knives spacedly disposed on the outer peripheral surface of said rotary drum at a predetermined helical angle with respect to a virtual cylindrical outer surface which blade edges of said knives will draw;

means for rotating said rotary drum shaped cutter about said first axis of rotation at a first predetermined speed;

an abrasive wheel, having a second axis of rotation, adapted to grind said knife blade edges;

means for rotating said abrasive wheel about said second axis of rotation at a second predetermined speed, said first and second predetermined speeds being set at a predetermined ratio;

movable support means for supporting said abrasive wheel for rotation about said second axis of rotation for grinding engagement with said knife blade edges with said second axis of rotation declined at a predetermined angle to a vertical plane perpendicular to said first axis of rotation, said first predetermined speed in conjunction with said second predetermined speed and said predetermined angle producing a composite vector composed of a peripheral velocity vector of said rotary drum shaped cutter and a peripheral velocity vector of said abrasive wheel which is parallel to each of said knife blade edges in the longitudinal direction of each of the knives, said movable support means being reciprocally movable in the axial direction of said first axis of rotation;

reciprocation means for moving said movable support means reciprocally in said axial direction of said first axis of rotation.

2. A knife abrasive apparatus for a rotary drum shaped cutter according to claim 1, wherein said movable supporting member is mounted on guide shafts for movement in the axial direction, said guide shafts being disposed in parallel with respect to the rotary center axis of said rotary drum shaped cutter within a same horizontal plane.

3. A knife abrasive apparatus for a rotary drum shaped cutter according to claim 1, wherein said abrasive wheel includes an abrasive plane.

4. A knife abrasive apparatus for a rotary drum shaped cutter according to claim 3, wherein said abrasive plane is depressed in a circular arc shape generally in agreement with said virtual cylindrical outer surface.

5. A knife abrasive apparatus for a rotary drum shaped cutter according to claim 3, wherein said abrasive plane is substantially parallel to the axis of the abrasive wheel.

6. A knife abrasive apparatus for a rotary drum shaped cutter according to claim 3, wherein said abrasive plane extends at an angle to the axis of the abrasive wheel.

* * * * *